United States Patent [19]

Gaysert

[11] 4,143,117

[45] Mar. 6, 1979

[54] ELASTIC MOUNTING FOR A CATALYTIC CONVERTER IN AN INTERNAL COMBUSTION ENGINE

[75] Inventor: Gerhard Gaysert, Esslingen, Fed. Rep. of Germany

[73] Assignee: J. Eberspacher, Esslingen, Fed. Rep. of Germany

[21] Appl. No.: 424,739

[22] Filed: Dec. 14, 1973

[30] Foreign Application Priority Data

Dec. 16, 1972 [DE] Fed. Rep. of Germany ..... 2261663

[51] Int. Cl.[2] ..... B01J 8/00; F01N 3/15

[52] U.S. Cl. ..... 422/179; 138/112; 422/180

[58] Field of Search ..... 23/288 FC; 60/299; 138/112

[56] References Cited

U.S. PATENT DOCUMENTS

| | | | |
|---|---|---|---|
| 2,807,930 | 10/1957 | Bratton | 23/288 FC UX |
| 3,404,965 | 10/1968 | Shiller | 23/288 FC UX |
| 3,441,381 | 4/1969 | Keith et al. | 23/288 FC |
| 3,441,382 | 4/1969 | Keith et al. | 23/288 FC |
| 3,597,165 | 8/1971 | Keith et al. | 23/288 FC |
| 3,692,497 | 9/1972 | Keith et al. | 23/288 FC |
| 3,785,781 | 1/1974 | Hervert et al. | 23/288 FC UX |
| 3,798,006 | 3/1974 | Balluff | 23/288 FC |
| 3,801,289 | 4/1974 | Wiley | 23/288 FC |
| 3,817,714 | 6/1974 | Wiley | 23/288 FC |

FOREIGN PATENT DOCUMENTS

| | | | |
|---|---|---|---|
| 791117 | 7/1968 | Canada | 23/288 FC |

*Primary Examiner*—Barry S. Richman

*Attorney, Agent, or Firm*—Toren, McGeady and Stanger

[57] ABSTRACT

In an internal combustion engine, a catalytic converter is elastically mounted within a tubular housing in the radial and axial directions by hollow rings. The hollow rings are located at each end of the catalytic converter and are formed, at least in part, of a thin metal foil skin or shell enclosing an elastic material such as a wire mesh or a fibrous ceramic material. Various shapes of hollow rings can be used, for instance, a single L-shaped ring can provide both radial and axial mounting at one end of a catalytic converter or a pair of oval-shaped hollow rings can be employed at one end with one ring providing radial mounting and the other ring affording axial mounting.

10 Claims, 3 Drawing Figures

ELASTIC MOUNTING FOR A CATALYTIC CONVERTER IN AN INTERNAL COMBUSTION ENGINE

SUMMARY OF THE INVENTION

The present invention is directed to an elastic mounting for a catalytic converter used for treating the exhaust gases in an internal combustion engine with the converter being formed of a monolithic honeycomb structure embodying the catalyst for the catalytic oxidation and/or reduction of harmful or environment-polluting constituents contained in the exhaust gas and, more particularly, it is directed to a hollow ring structure for providing the elastic mounting of the converter in both the radial and axial directions.

Among the polluting substances presently known to be present in exhaust gases in internal combustion engines are carbon monoxide, CO, unburnt of slightly burnt hydrocarbons $C_xH_y$, as well as nitric oxides $NO_x$.

It is known that catalysts can be used advantageously in converting such harmful substances as they pass through the exhaust system in an internal combustion engine.

At the present time, the catalytically active substance, for instance, in exhaust gas catalytic converters, is located in a porous ceramic carrier in the form of small cylindrical or spherical pellets. These pellets, which usually are between 1 and 4mm in diameter, are positioned in a metal housing provided with perforated plates through which the exhaust gas passes as it leaves the internal combustion engine.

The principal disadvantages of such pellet-type catalytic converters are:

1. the great flow resistance and, as a result, the high exhaust gas back pressure associated with such converters, which result in a drop in the maximum attainable performance of the internal combustion engine;

2. the relatively high heat capacity $G \cdot C_p$ of the catalytic material, which prevents rapid heating of the system to its operating temperature after a cold start of the engine; and 3. the high abrasion of the pellet-type catalytic material, which does not ensure the attainment of the minimum life of the converter prescribed by the authorities.

It has also been known that monolithic members formed of a continuous skeleton of porous ceramic material can be used advantageously as a carrier for the catalyst. Such elements, known in the trade as "honeycomb structures" consist, as a rule, of cylindrical blocks about 100mm in diameter and having lengths in the range of 50 to 200mm. These dimensions are typical of the exhaust catalytic converters used in European medium-sized passenger cars.

The flow channels formed by the skeleton structure usually has a square or trapezoidal cross section with an inside cross sectional area of between 1 to 3mm$^2$. In a structure of the above-described size, several thousand parallel flow channels are provided, each having a practically constant cross section. An example of a ceramic honeycomb structure is described in DOS 1476507. These honeycomb structures have a relatively low mechanical strength, due to their low wall thickness which are of a few tenths of a millimeter, and they are susceptible to stress caused by abruptly changing temperatures, particularly thermal shocks. The coefficient of thermal expansion is much lower than in the metal alloys used as supports for the converter. Accordingly, it is practically impossible to provide a direct mounting of the honeycomb structure in a rigid metal housing. Tests have been performed in which the honeycomb structure was mounted in a metal housing with an intermediate layer of high-temperature resistant ceramic fibers, however, such arrangements have, thus far, proved to be unsatisfactory. The great pulsation of the exhaust gases with dynamic alternating pressures of several tenths of an atmosphere in connection with the high gas temperatures of 800° C. or more causes destruction of the ceramic fibers after only a few hours of operation.

To maintain the elastic properties of the embedment fully effective under the most unfavorable operating conditions and to prevent relative movement between the housing and the honeycomb structure because of variations in thermal expansion, it has been suggested to provide an elastic support for securing the honeycomb structure within the housing which support is fully effective at high temperatures. A pretreated metal mesh has been considered particularly suitable as the material for the elastic support. Further, in this known arrangement the elastic embedment of the honeycomb structure can be effected by a resilient metal bellows bearing on the housing.

It has been found that such an arrangement still requires certain expenditures for the assembly and precision fitting of the parts used.

The present invention is directed to this problem of positioning catalytic converters in the exhaust system of internal combustion engines and it solves the problem by elastically mounting the ceramic catalyst carriers so that the support of the carrier can be effected in a simple manner and with elements which can be produced as standard parts.

Starting with the state of the art disclosed in German patent application P 22, 45, 535, this problem has been solved in accordance with the present invention by using at least two mounting elements each in the form of a hollow ring for providing the elastic support of the catalyst carrier. A feature of the hollow rings is that their outer skin or shell is formed, at least in part, of a thin metal foil. It has been found that very sensitive ceramic carriers can be mounted in a simple and safe manner due to the elastic support provided by the hollow rings. Another feature of the hollow rings is that their outer shell or skin forms a closed cavity or space which is filled with an elastic material, such as a wire mesh. It has been found that a ceramic fiber can be used in place of the wire mesh or a combination of both the wire mesh and ceramic fibers can be utilized. Due to the use of an elastic material within the hollow ring, a sufficient elasticity is provided in the mounting and the shell or skin of the ring can be very thin, hence the use of metal foil. The metal foil acts as protection for the enclosed elastic material against the exhaust gas current so that the elastic materials are not carried into the honeycomb structure embodying the catalyst.

In one embodiment of the present invention, the hollow ring has an L-shaped, angular cross section so that one of its legs contacts the circumferential surface of the honeycomb structure while the other leg contacts the transverse edge of the honeycomb structure. Such an L-shaped member is suitable for a particularly simple mounting.

It has been found to be expedient when using such an L-shaped hollow ring to provide a composite skin or shell structure with a heavier metal member forming the outwardly facing portion of the shell and a thin metal foil forming the inwardly facing surface of the shell which contacts the honeycomb structure. The two portions of the shell are rigidly secured to one another at their junction. This specific structure of the hollow ring affords a particularly high elasticity of the mounting arrangement.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
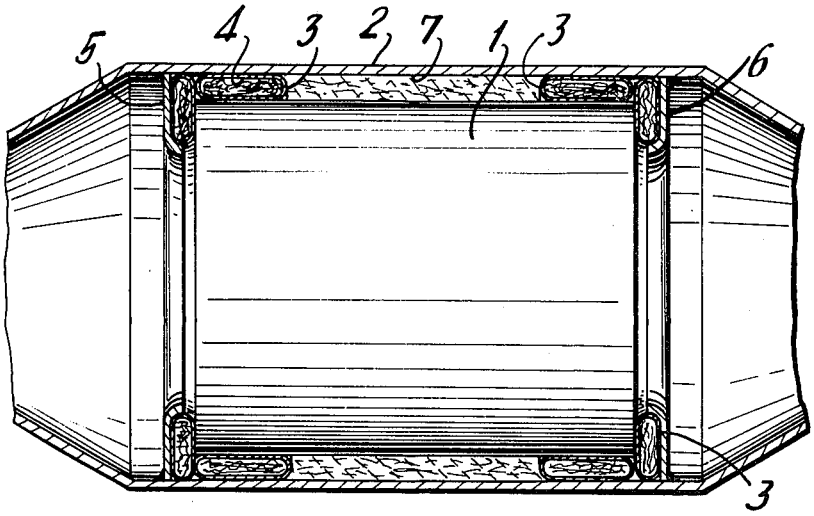
FIG. 1 is an axially extending cross sectional view of an elastic mounting arrangement for a honeycomb structure catalytic converter, embodying the present invention and utilizing a total of four elastic supporting elements.

In FIG. 1 a monolithic ceramic honeycomb structure catalyst converter 1 is elastically mounted within a tubular shaped metal housing 2. The elastic mounting is provided by positioning hollow rings 3 between the ends of the catalyst converter 1 and the surfaces of the tubular housing 2. The shell or skin of the hollow rings is a thin metal foil which is a temperature-resistant material and forms a closed space or cavity 4. The cavity 4 within the hollow rings can be filled with various materials, for example, with a wire mesh which has the advantage of great form stability or with fibrous ceramic material which has the advantage of high temperature-resistance. Fiberfrax or Cerafelt can be used as the fibrous ceramic material and while such materials can withstand temperatures up to 1100° C., they do not have sufficient mechanical strength to withstand the great pulsations present in the exhaust gas current. Accordingly, the metal foil skin of the hollow rings protects the fibrous ceramic material from the action of the exhaust gas current. As shown in FIG. 1, there are two hollow rings 3 arranged at each end of the catalytic converter 1 providing a total of four such elements for each mounting. At each end, one ring extends about the circumference of the converter and provides elastic mounting in the radial direction while the other ring is positioned in contact with the transverse end of the converter and provides elastic mounting in the axial direction. It will be noted that the oval rings extending about the circumference of the converter have their major axes extending in the axial direction of the housing and the converter while the rings in contact with the transverse end of the converter have their major axes extending in the radial direction of the housing or the converter. At the opposite ends of the catalytic converter 1 stop disks 5, 6 extend radially inwardly from the tubular housing 2 and are welded to the housing. These disks 5,6 provide the axial limitation for the movement of the catalytic converter and they are axially braced in position before the welding step is performed.

Since the rings mounting the catalytic converter 1 in the axial direction are spaced inwardly from the tubular housing 2, a ring-shaped space 7 is provided about the catalytic converter between the rings 3. This space 7 is filled with a ceramic fiber and insures a good heat insulation between the catalytic converter and the housings. The heat bridges formed by the metal foil rings are insignificant, since the metal foil is thin.

Figure 2:
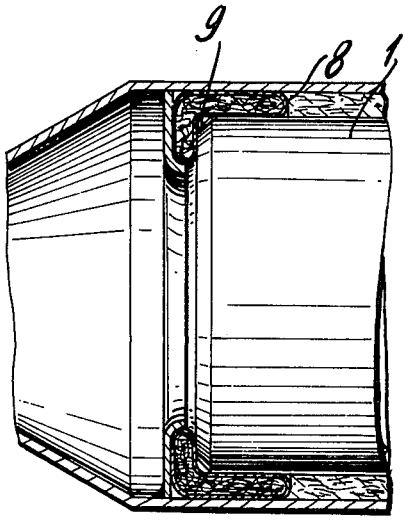
FIG. 2 is a partial cross sectional view, similar to FIG. 1, where a single supporting element is used at each end of the catalytic converter.

As distinguished from the embodiment shown in FIG. 1, in FIG. 2 a single L-shaped hollow ring 8 provides the elastic mounting for the catalytic converter in both the radial and axial direction. In effect, the separate oval-shaped hollow rings 3, as shown in FIG. 1, are combined to form the single L-shaped hollow ring 8 of FIG. 2. The shell or skin of the hollow ring 8 is formed of a metal foil while its interior space is filled with an elastic material such as in the hollow rings 3 of FIG. 1. The L-shaped hollow ring 8 is seated against the circumferentially extending end edge 9 of the catalytic converter 1 so that one leg extends along the circumferential surface of the converter and provides elastic mounting in the radial direction while the other leg extends radially inwardly from the edge 9 and provides elastic mounting in the axial direction. Accordingly, instead of using two rings at each end, a simplified arrangement is provided wherein a single L-shaped hollow ring 8 mounts each end of the catalytic converter.

Figure 3:
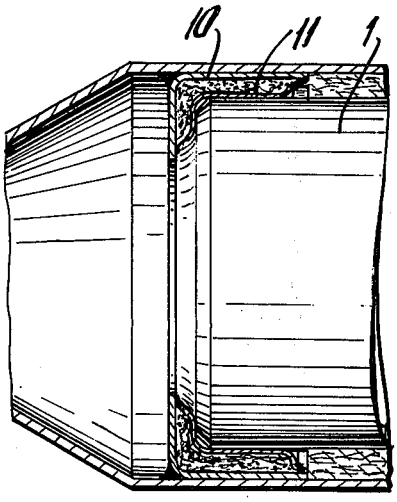
FIG. 3 is another partial cross sectional view showing a variation of the supporting element illustrated in FIG. 2.

In FIG. 3, another embodiment of the L-shaped hollow ring 8 is illustrated where the outwardly facing surface 10 of the ring is formed of a relatively thick metal, for example, about 1 mm, while the inwardly facing surface 11 is formed of a thin metal foil and the two surfaces 10, 11 are rigidly joined to one another by welding or by embedding one within the other. This particular embodiment serves to increase the elasticity of the mounting.

An essential advantage of the elastic mounting provided by the present invention is the "quasi-hydraulic" effect of the hollow ring 3 with its cavity 4 filled with elastic material. The bending resistance of the metal foil is low and, as a result, the resistance to normal forces is provided, to a great extent, by the elastic properties of the filling in the cavity 4. There is a great freedom in the section of the materials filled into the hollow ring since they are protected from the exhaust gas current by the shell or skin of the ring and, accordingly, no erosive forces can act on them.

While specific embodiments of the invention have been shown and described in detail to illustrate the application of the inventive principles, it will be understood that the invention may be embodied otherwise without departing from such principles.

I claim:

1. A catalytic reactor for purifying exhaust gases from an internal combustion engine comprising a cylindrical tubular casing, a monolithic catalyst positioned within said casing, and at least two hollow rings formed of a metallic resilient material filled with a mass of resilient material and positioned within and in contact with said cylindrical tubular housing and arranged to elastically mount the monolithic catalyst within and to space it from said casing, and said hollow rings formed of a metallic resilient material each comprising a metal foil skin forming a closed cavity.

2. A catalytic reactor, as set forth in claim 1, wherein said metal foil skin is filled with a mass of elastic material.

3. A catalytic reactor, as set forth in claim 2, wherein said elastic material filling said metal foil skin is a mass of wire mesh.

4. A catalytic reactor, as set forth in claim 2, wherein said elastic material filling said metal foil skin is a mass of fibrous ceramic material.

5. A catalytic reactor, as set forth in claim 2, wherein said mass of elastic material filling said metal foil skin is a combination of wire mesh and fibrous ceramic material.

6. A catalytic reactor for purifying exhaust gases from an internal combustion engine comprising a cylindrical tubular casing, a monolithic catalyst positioned within said casing, and at least two hollow rings formed of a metallic resilient material filled with a mass of resilient material and positioned within and in contact with said cylindrical tubular housing and arranged to elastically mount the monolithic catalyst within and to space it from said casing, said hollow rings being L-shaped in axial cross section with one leg of the L-shaped cross section extending transversely of the axis of said tubular casing and the other leg extending in generally parallel relationship with the axis of said tubular casing, said one leg arranged to elastically mount the transversely extending end of the monolithic catalyst and the other leg arranged to elastically mount the circumferential periphery of the monolithic catalyst, said L-shaped cross sectional hollow rings each comprising a supporting shell forming a closed space, and the mass of resilient material comprising an elastic material filled within the closed space formed by said shell, said shell having a first section arranged to face inwardly toward the monolithic catalyst and a second section arranged to face outwardly toward said tubular casing in the radial direction and away from the monolithic catalyst in the axial direction, said first section being formed of a metal foil and said second section being formed of a metal section thicker and heavier than said metal foil and means rigidly securing the junction of said first and said second sections together.

7. A catalytic reactor, as set forth in claim 6, wherein said said securing means comprises a welded seam.

8. A catalytic reactor, as set forth in claim 6, wherein said supporting shell is filled with a mass of wire mesh.

9. A catalytic reactor, as set forth in claim 6, wherein said supporting shell is filled with a mass of fibrous ceramic material.

10. A catalytic reactor, as set forth in claim 6 wherein said supporting shell is filled with a mass comprising a combination of wire mesh and fibrous ceramic material.

* * * * *